US008068064B2

(12) United States Patent
Yanagisawa et al.

(10) Patent No.: US 8,068,064 B2
(45) Date of Patent: Nov. 29, 2011

(54) WIDE BAND ANTENNA

(75) Inventors: Wasuke Yanagisawa, Tokyo (JP); JunXiang Ge, Tokyo (JP)

(73) Assignee: Yokowo, Co., Ltd., Tokyo (JP)

( * ) Notice: Subject to any disclaimer, the term of this patent is extended or adjusted under 35 U.S.C. 154(b) by 560 days.

(21) Appl. No.: 11/913,396

(22) PCT Filed: Apr. 27, 2006

(86) PCT No.: PCT/JP2006/309206

§ 371 (c)(1),
(2), (4) Date: Jan. 26, 2009

(87) PCT Pub. No.: WO2006/118324

PCT Pub. Date: Nov. 9, 2006

(65) Prior Publication Data

US 2009/0167622 A1 Jul. 2, 2009

(30) Foreign Application Priority Data

May 2, 2005 (JP) ..... 2005-133910

(51) Int. Cl.
*H01Q 13/10* (2006.01)
*H01Q 3/00* (2006.01)

(52) U.S. Cl. ..... 343/772; 343/762; 343/702

(58) Field of Classification Search ..... None
See application file for complete search history.

(56) References Cited

U.S. PATENT DOCUMENTS 2,944,258 A 7/1960 Yearout et al.
3,031,665 A 4/1962 Marie
4,843,403 A * 6/1989 Lalezari et al. ..... 343/767
5,146,232 A * 9/1992 Nishikawa et al. ..... 343/713
2002/0109643 A1 8/2002 Buckles
2003/0201944 A1 10/2003 Aikawa et al.
2004/0169609 A1 * 9/2004 Song et al. ..... 343/767

FOREIGN PATENT DOCUMENTS

JP 01-295503 11/1989
JP 2-23702 1/1990
JP 03-253106 11/1991
JP 04-049704 2/1992
JP 09-223921 8/1997
JP 2001-217636 8/2001

(Continued)

OTHER PUBLICATIONS

Japanese Office Action dated Aug. 18, 2010.

(Continued)

*Primary Examiner* — Trinh Dinh

(74) *Attorney, Agent, or Firm* — Bachman & LaPointe, P.C.

(57) ABSTRACT

There is provided a low-cost wide band antenna having an ultra-wide band and high performance. The wide band antenna includes an antenna element to form a shape of a ridge waveguide open cross-section structure together with GND (10) when it is spread. The antenna element has a ridge element portion (13) corresponding to the ridge portion of the ridge waveguide and a radiation element portion (14) corresponding to the wall of the ridge waveguide and extending from the ridge element portion (13) for electromagnetic wave radiation. Moreover, the antenna element has an opposing auxiliary element (12) having the same shape and structure as the ridge element portion (13). The radiation element portion (14) has an end arranged on the GND (10). The ridge element portion (13) has a tip end connected to a power supply terminal (100).

15 Claims, 10 Drawing Sheets

FOREIGN PATENT DOCUMENTS

| | | | |
|---|---|---|---|
| JP | 2001-313517 | | 11/2001 |
| JP | 2003-273638 | A | 9/2003 |
| JP | 2004-328693 | | 11/2004 |
| WO | WO 20041010531 | A1 | 1/2004 |

OTHER PUBLICATIONS

Soler J et al: "Dual-band sierpinski fractal monopole antenna" Antennas and Propagation Society International Symposium, 2000. IEEE Jul. 16-21, 2000, Piscataway, NJ, USA. IEEE, vol. 3, Jul. 16, 2000, pp. 1712-1715.

XP010515249—ISBN: 0-7803-6369-8.

Supplementary European Search Report Dated April 22, 2008.

International Search Report Dated Jul. 25, 2006.

Chinese Office action for Chinese Patent Application No. 200680022112.0, dated May 6, 2011.

* cited by examiner (a)

(b)

(a)

(b)

(a)

(b)

(a)

(b)

(a)

(b)

WIDE BAND ANTENNA

RELATED APPLICATIONS

This application is a 371 of PCT/JP2006/309206 filed Apr. 27 2006, which claims priority under 35 U.S.C. 119 to an application JP 2005-133910 filed on May 02 2005, the contents of which are incorporated herein by reference.

TECHNICAL FIELD

The present invention relates to a wide band communication system such as an ultra wide band (UWB) system, and a wide band antenna used in wireless systems operating in different frequency bands.

BACKGROUND ART

As antennas used in a wide band communication system, a multiple element antenna, a spiral antenna, a log periodic antenna, and the like are known.

The multiple element antenna is an antenna configured to obtain wide-band antenna characteristics by combining many antenna elements each having slightly different frequency bands. This multiple element antenna has a superior characteristic as to wide-band property, but there is a need to combine multiple antenna elements, which leads to a difficulty to adjust a feeding impedance of each antenna element and adjust a resonance frequency thereof. The spiral antenna and the log periodic antenna are simple in structure but their overall volumes are large and, in addition, their directional characteristics are limited only to a ground plane and a vertical direction when attached with the ground.

Also, in general, widening of practicable frequency bands of the multiple element antenna, the spiral antenna, and the log periodic antenna makes designing and adjustment thereof very difficult. Therefore, it has conventionally been difficult to realize a wide band antenna whose mass production is easy.

In recent years, a wide band communication system, such as a UWB system, has been applied in various fields. Also in an automobile, a mobile terminal, such as an on-vehicle wireless device, a portable telephone, or a PDA (Personal Digital Assistance) , a radio wave sensor, or the like is used. For instance, it is becoming not rare that an AM/FM radio receiver, an on-vehicle TV set, a GPS receiver, a satellite digital broadcasting receiver, a cellular phone, an ETC unit, a Bluetooth device, and a W-LAN are used in one automobile.

When terminals or systems that use frequencies in various bands are used like in this case, there arises a necessity to, for instance, attach many antennas to one automobile, which leads to a problem that an antenna installation space is increased as well as a problem that a cost is unusually increased.

One object of the present invention is to provide a low-cost wide band antenna having an ultra-wide band and high performance, with which it becomes possible to solve all of the problems described above.

DISCLOSURE OF THE INVENTION

A wide band antenna according to the present invention includes an antenna element in a shape forming a part or all of an open cross-section structure of a waveguide when being spread. The antenna element includes a first element portion for electromagnetic wave radiation and a second element portion for antenna characteristic adjustment, and a power supply terminal is connected to the first element portion through, or together with, the second element portion. The antenna characteristics are an impedance characteristic, a VSWR characteristic, or a radiation characteristic, for instance.

In the wide band antenna having such a structure, the antenna element performs an operation in conformity with a mode theory of the waveguide.

As an electromagnetic wave that passes through the waveguide, there are a TE mode wave and a TM mode wave. A surge impedance Zw of the TE mode wave and an impedance Ze of the TM mode wave respectively become as follows.

$$Zw=Zo/\sqrt{(1-(fc/f)^2)}$$

$$Ze=Zo\cdot\sqrt{(1-(fc/f)^2)}$$

Here, $Zo=120\pi\cdot\sqrt{(\mu r/\epsilon r)}$, with $\mu r$ being a relative permeability of a propagation medium and $\epsilon r$ being a relative permittivity of the propagation medium. In the case of a free space, $\mu r=\epsilon r=1$ and Zo becomes $120\pi$.

When a frequency f of a signal is higher than a cutoff frequency fc of the waveguide, the signal passes through this waveguide. When the frequency f of the signal is limitlessly higher than the cutoff frequency fc, values of Zw and Ze become $120\pi$like Zo in a free space. Accordingly, the wide band antenna according to the present invention operates in an operation mode, such as an operation mode of a high pass filter, in which when the cutoff frequency fc is determined, all frequencies f that are significantly higher than the cutoff frequency fc are passed. One feature of the wide band antenna according to the present invention is that such an operation mode is applied. It is possible to adjust the antenna characteristics by the second element portion.

The waveguide may include a ridge waveguide. In other words, specifically, it is possible to construct the wide band antenna according to the present invention to include an antenna element that forms a shape of an open cross-section structure of a ridge waveguide together with the ground plane when it is spread on a plane.

The antenna element includes a ridge element portion for antenna characteristic adjustment corresponding to a ridge portion of the ridge waveguide and a radiation element portion for electromagnetic wave radiation corresponding to a wall of the ridge waveguide and extending from the ridge element portion, with a power supply terminal being connected to a tip end of the ridge element portion.

With this wide band antenna, an operation in conformity with a mode theory of the ridge waveguide becomes possible. A cutoff frequency fc of the ridge waveguide is lower than that of an ordinary rectangular waveguide having the same cross-section size, for instance. Therefore, it becomes possible to realize an antenna in which wide-band property is maintained while lowering a usable frequency. Also, a plane portion that is the ridge element portion is included, so a matching range is broadened as compared with a case where, for instance, a wire is wound. In other words, it also becomes possible to suppress a mismatch at the power supply terminal while achieving a function as an electromagnetic wave radiator. At the time of designing and production, it is sufficient that consideration is given only to the lowest frequency whose use is planned, which facilitates mass production and also realizes cost reduction.

In a preferable embodiment, the ridge element portion is formed in an approximately arc shape. By forming into such a shape, an upper limit of a usable frequency is limitlessly raised, which makes it possible to make the wide band property more prominent.

The ridge element portion may have, for instance, a one base end structure obtained by cutting the ridge portion of the ridge waveguide in the open cross-section structure in a height direction. In this case, the radiation element portion is set so as to extend from a base end of the ridge element portion.

In the wide band antenna, when electricity from the power supply terminal is fed to a center portion of the ridge element portion, there occur multiple mode waves that are symmetric with the site as a center. In the case of the ridge waveguide, an electric field strength of a passing electromagnetic wave becomes the maximum at a center ($TE_{10}$) of the ridge portion, so even when the ridge element portion is given a one base end structure, the characteristics themselves of a high pass filter do not differ from that in the case of a both base end structure to be described later. It becomes possible to reduce a size thereof by a degree corresponding to the one base end structure.

It should be noted here that it does not matter which one of a construction, in which an odd number mode ($TE_{10}$, $TE_{30}$, $TE_{50}$) is used, and a construction, in which an even number mode ($TE_{20}$, $TE_{40}$, . . . ) is used, is selected but it is preferable that the construction, in which the odd number mode is used, is selected.

The ridge element portion may have, for instance, a both base end structure that is symmetric with a site, at which a height of the ridge portion of the ridge waveguide becomes the maximum, in the open cross-section structure as a center line. In this case, the radiation element portion is set so as to extend from each of both base ends of the ridge element portion.

The radiation element portion may be set so as to extend from each of the both base ends of the ridge element portion in a predetermined angle direction with respect to the ridge element portion.

More preferably, the radiation element portion is set so as to extend from each of the both base ends of the ridge element portion vertically with respect to the ridge element portion in mutually opposite directions.

It should be noted here that the two antenna elements may be set to intersect at right angles with a symmetric center line of each ridge element portion as a base point. With this construction, it becomes possible to enhance an antenna gain and also broaden directional characteristics while favorably maintaining the wide band property.

The ridge element portion may have, for instance, a both base end structure that is symmetric with a site, at which a height of the ridge portion of the ridge waveguide becomes the maximum, in the open cross-section structure as a center line and is bent on a wide plane of the ridge waveguide at a predetermined angle. In this case, in the radiation element portion, first elements that each correspond to a wide wall of the ridge waveguide are set so as to extend from both base ends of the ridge element portion and share a second element corresponding to a side wall of the ridge waveguide.

In the wide band antenna having such a structure, it becomes possible to use a rectangular parallelepiped shape whose one side size is approximately a half of the ridge portion of the ridge waveguide, which makes it possible to achieve miniaturization while favorably maintaining an antenna gain and directivity.

In a more preferable embodiment of the present invention, the wide band antenna having the fluctuations described above is provided with an auxiliary element having the same shape and structure as the ridge element portion of the antenna element. This auxiliary element is mainly provided for antenna characteristic adjustment together with the ridge element portion of the antenna element. Therefore, in this specification, the term "auxiliary element" is used for distinction from the antenna element.

In this embodiment, a base end of the auxiliary element is arranged on a ground plane, and the auxiliary element and the ridge element portion oppose each other on the same plane. An end of the radiation element portion of the antenna element is arranged on the ground plane, and the power supply terminal is connected to a site at which a tip end of the auxiliary element and a tip end of the ridge element portion come closest to each other.

The wide band antenna having such a structure operates in an operation mode in conformity with a mode theory of a so-called double ridge waveguide, so a frequency band in which it is possible to establish impedance matching is greatly widened, which makes it possible to remarkably enhance the wide band property.

According to the present invention, it becomes possible to realize an ultrawide-band property in which there merely exists a usable lowest frequency. Ordinarily, it has been difficult to widen a band of an antenna provided with the ground but according to the present invention, it becomes possible to widen the band of such an antenna.

Also, approximately non-directivity is achieved on a horizontal plane, which enables use for general purpose.

BEST MODE FOR CARRYING OUT THE INVENTION

Hereinafter, embodiments of the present invention will be described with reference to the drawings.

First Embodiment

Figure 1:
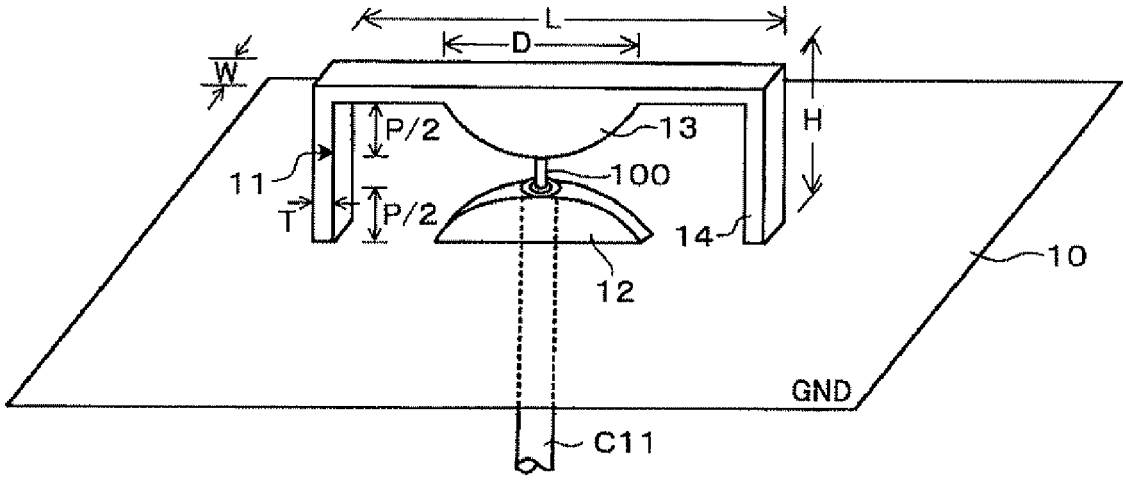
In FIGS. 1, part (*a*) is an external perspective view of a wide band antenna according to a first embodiment of the present invention, and part (*b*) is a graph showing VSWR characteristics of the antenna.
Figure 1:
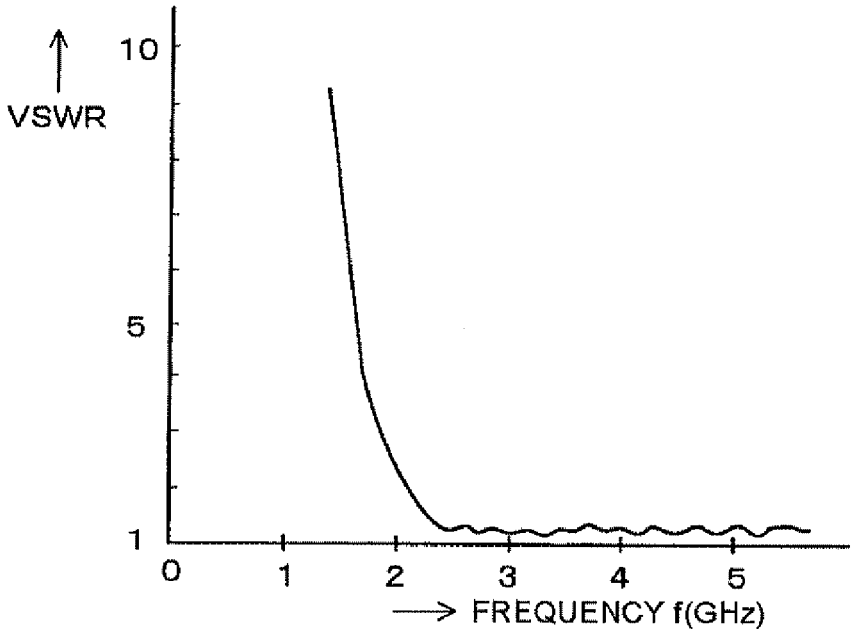

FIG. 1(*a*) is an external perspective view of a wide band antenna according to a first embodiment of the present invention and FIG. 1(*b*) is a graph showing VSWR characteristics. It should be noted here that the VSWR characteristics are one example of the antenna characteristics.

In the wide band antenna in this embodiment, a double (cylinder) ridge waveguide having a rectangular shape is cut in a tube axial direction at a predetermined thickness and one wide plane is used as the ground plane (hereinafter referred to as the "GND"). This wide band antenna performs an operation in conformity with a mode theory of the double ridge waveguide and includes an antenna element 11 and an auxiliary element 12. The antenna element 11 and the auxiliary element 12 are each made of a metal that is high in conductivity.

The antenna element 11 forms a shape of a ridge waveguide open cross-section structure together with the GND 10 when it is spread. In other words, the antenna element 11 includes a ridge element portion 13 corresponding to a ridge portion of an upper wide plane in the double ridge waveguide open cross-section structure and a radiation element portion 14 for electromagnetic wave emission corresponding to a wall other than a lower wide plane. The ridge element portion 13 in this embodiment has a both base end structure that is symmetric with a site, at which a height of the ridge portion becomes the maximum, as a center line. A tip end of this ridge element portion 13 is formed in an approximately arc shape. The ridge element portion 13 having such a structure acts in substantially the same manner as the ridge portion of the upper wide plane of the double ridge waveguide.

The radiation element portion 14 acts in substantially the same manner as a wall of the double ridge waveguide. This radiation element portion 14 includes a first radiation element extending from each of both ends of the ridge element portion 13 in parallel with the GND 10 and a second element extending from each end portion of this first radiation element toward the GND 10 in a vertical direction. Ends of the second element, in other words, ends of the radiation element portion 14 are arranged on the GND 10.

The auxiliary element 12 has the same shape and structure as the ridge element portion 13 of the antenna element. In other words, the auxiliary element 12 corresponds to an element obtained by removing the radiation element portion 14 from the antenna element 11. A base end thereof is arranged on the GND 10. The auxiliary element 12 and the ridge element portion 13 of the antenna element oppose each other on the same plane and a power supply terminal 100 is connected to a site at which their tip ends come closest to each other.

The auxiliary element 12 having such a structure acts in substantially the same manner as a ridge portion of a lower wide plane of the double ridge waveguide.

The power supply terminal 100 is set so that it is connected to a wireless communication device (not shown) through a cable C11.

In FIG. 1(*a*), when the sum of lengths of the ridge element portion 13 and the first element of the radiation element portion 14 of the antenna element 11 is referred to as "L", a length of the second element of the radiation element portion 14 is referred to as "H", a length of the ridge portion element 13 is referred to as "D", a thickness of the radiation element 14 is referred to as "T", and heights of the ridge element portion 13 and the auxiliary element are referred to as "P/2", a size of the wide band antenna in the case where the lowest frequency, in other words, a cutoff frequency is set to 1.5 [GHz] becomes as follows, for instance.

L=70 [mm], H=25 [mm], W=4 [mm], D=25 [mm], P=16 [mm], T=4 [mm]

An actual measurement value of VSWR characteristics of the wide band antenna having such a size is shown in FIG. 1(*b*). As can be seen from FIG. 1(*b*), when only the lowest frequency is determined by the size described above, every VSWR at a frequency that is higher than the lowest frequency by a predetermined value or more falls within a practical use range. Note that for a reason concerning a measuring instrument, quantification by a numerical value was not performed at five [GHz] or higher but it has been confirmed that the VSWR is favorably maintained even at a high frequency that is 20 [GHz] or higher.

Second Embodiment

Figure 2:
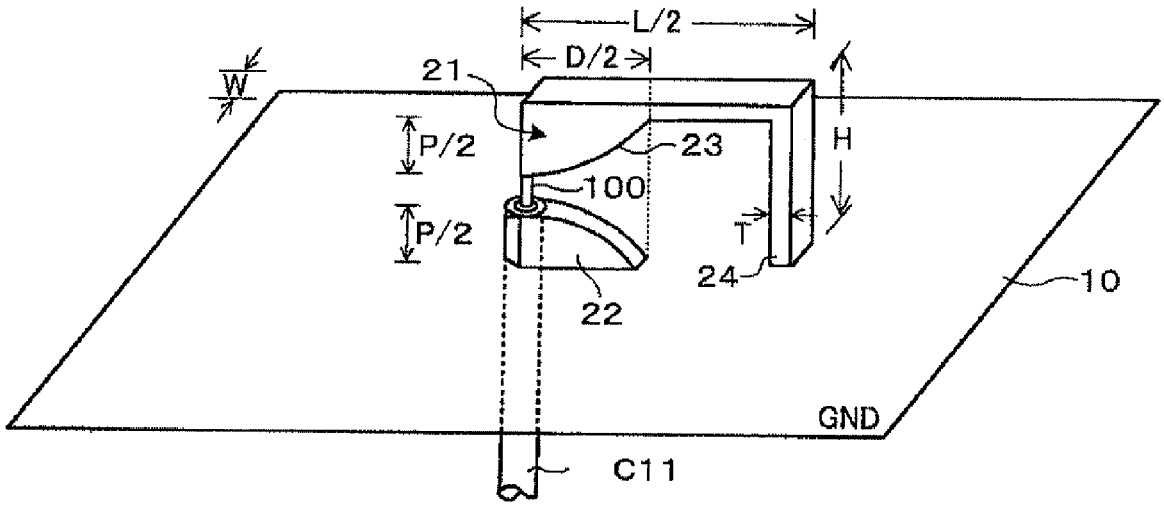
In FIGS. 2, part (*a*) is an external perspective view of a wide band antenna according to a second embodiment of the present invention, and part (*b*) is a graph showing VSWR characteristics of the antenna.
Figure 2:
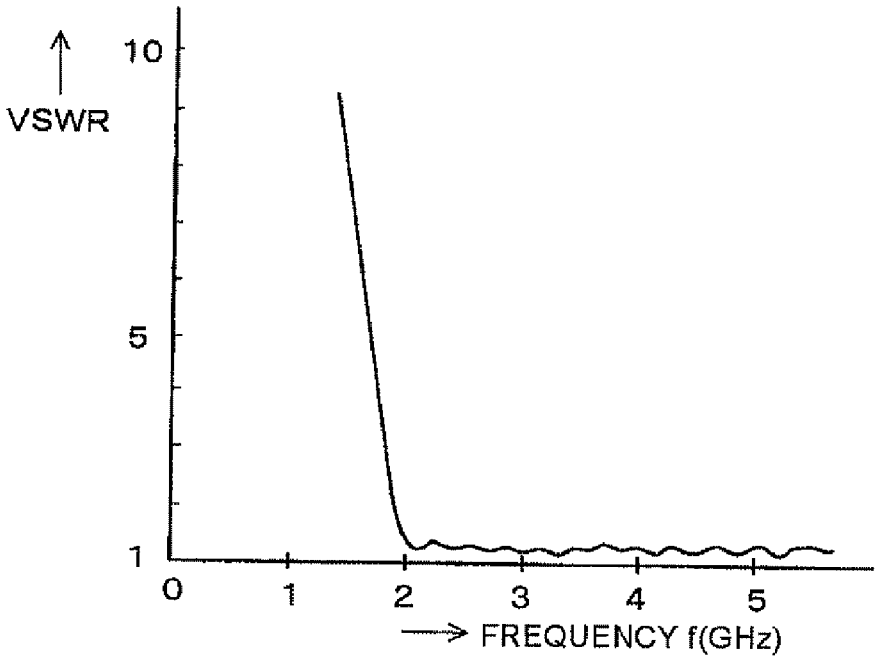

FIG. 2(*a*) is an external perspective view of a wide band antenna according to a second embodiment of the present invention and FIG. 2(*b*) is a graph showing VSWR characteristics.

As shown in FIG. 2(*a*), the wide band antenna in this embodiment has a structure in which a right half of a cross section of a double ridge waveguide is cut out. In other words, the wide band antenna includes an antenna element 21, which has a ridge element portion 23 having a one base end structure obtained by cutting a ridge portion of an upper wide plane in a double ridge waveguide open cross-section structure in its height direction and a radiation element 24, and an auxiliary element 22.

The ridge element portion 23 acts in substantially the same manner as the ridge portion of the upper wide plane of the double ridge waveguide. The radiation element portion 24 acts in substantially the same manner as a wall of the double ridge waveguide and is used for electromagnetic wave radiation in this embodiment. This radiation element portion 24 includes a first radiation element extending from the ridge element portion 23 in parallel with the GND 10 and a second element extending vertically to the GND 10, with an end portion of the second element being placed on the GND 10.

The auxiliary element 22 has the same shape and size as the ridge element portion 23 of the antenna element 21 and its base end is arranged on the GND 10. This auxiliary element 22 and the ridge element portion 23 oppose each other on the same plane and a power supply terminal 100 is connected to a site at which their tip ends come closest to each other. This power supply terminal 100 is set so that it is connected to a wireless communication device (not shown) through a cable C11.

In FIG. 2(*a*), L, H, W, D, P, and T assume the same values as described in the first embodiment. An actual measurement value of VSWR characteristics of the wide band antenna having such a size is shown in FIG. 2(*b*). As can be seen from FIG. 2(*b*), like in the case of the wide band antenna in the first embodiment, when only the lowest frequency is determined by the size described above, every VSWR at a frequency that is higher than the lowest frequency by a predetermined value or more falls within a practical use range.

It should be noted here that also in the case of this wide band antenna, for a reason concerning a measuring instrument, quantification was impossible at 5 [GHz] or higher but it has been confirmed that the VSWR is favorably maintained even at a high frequency that is 20 [GHz] or higher.

[Verification by Ridge Structure]

As already mentioned, a wide band antenna including an antenna element in a shape that forms a part or all of a waveguide open cross-section structure when it is spread has characteristics in conformity with an operation mode of the waveguide. Hereinafter, how antenna characteristics are influenced by the waveguide open cross-section structure, in particular, shapes of the antenna element, the auxiliary element, or the like will be verified.

Figure 3:
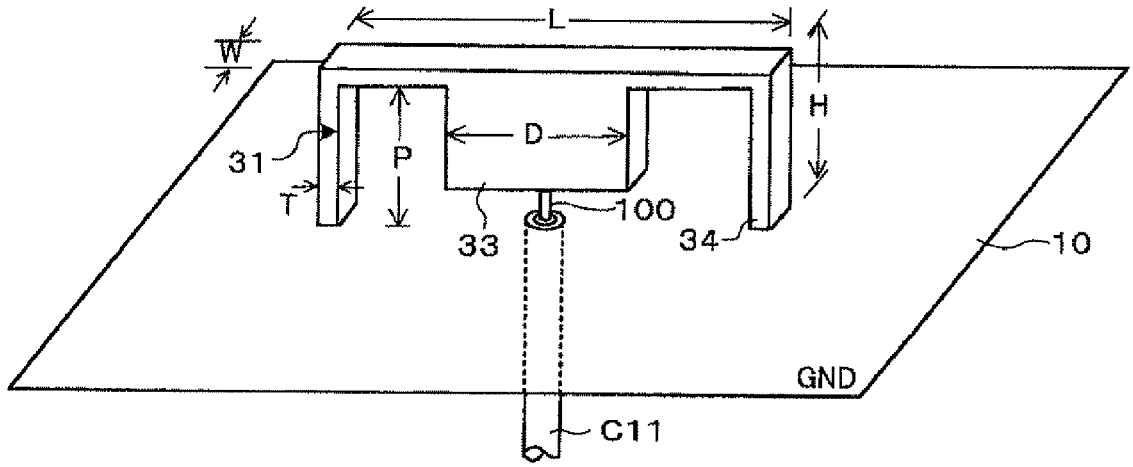
In FIGS. 3, part (*a*) is an external perspective view of an antenna for verification, and part (*b*) is a graph showing VSWR characteristics of the antenna.
Figure 3:
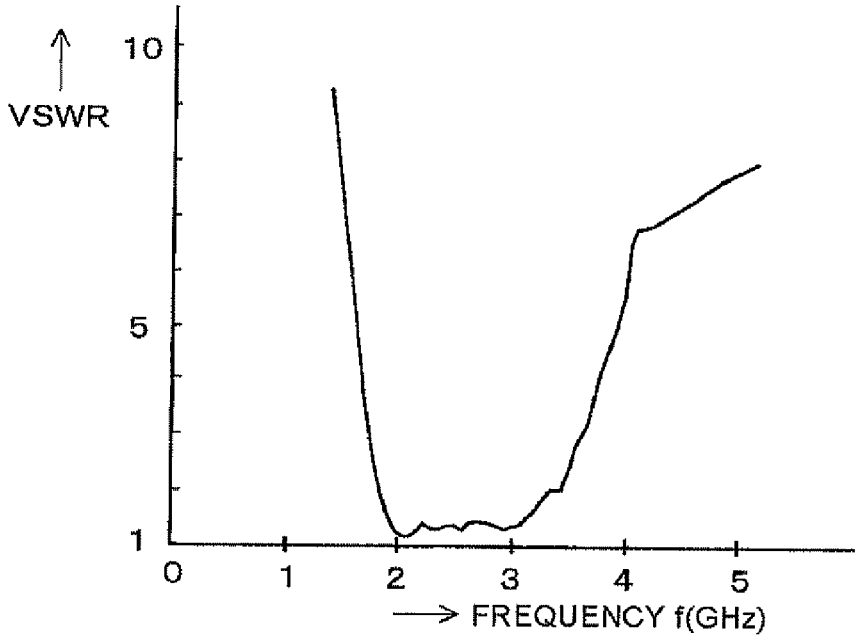

FIG. 3(*a*) is an external perspective view of a wide band antenna, in which a ridge element portion 33 of an antenna element 31 is formed in a rectangular shape integrally with a radiation element portion 34, and FIG. 3(*b*) is a graph showing VSWR characteristics of the antenna. The wide band antenna having such a structure includes no auxiliary element, so it substantially operates in an operation mode of a single ridge waveguide.

With such a wide band antenna, it is possible to obtain wide-band property at a practical use level, at which the VSWR is around two, but characteristic degradation becomes conspicuous in a band in which a frequency becomes high to some extent. Therefore, there is a certain limitation in a use range.

Figure 4:
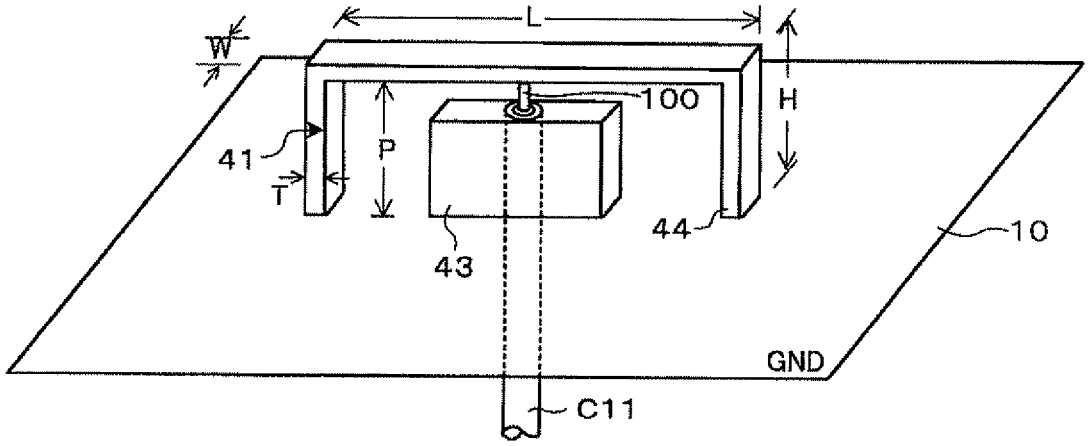
In FIGS. 4, part (*a*) is an external perspective view of an antenna for verification, and part (*b*) is a graph showing VSWR characteristics of the antenna.
Figure 4:
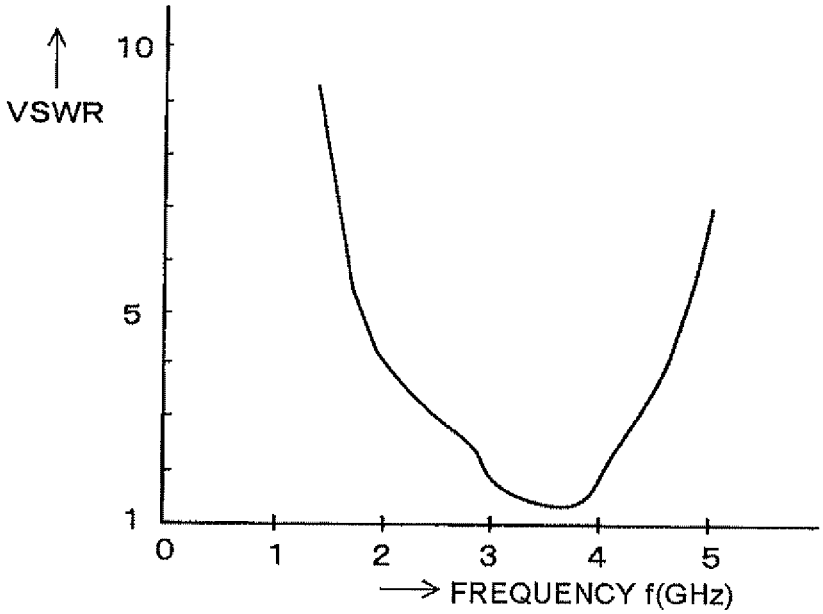

FIG. 4(*a*) is an external perspective view of a wide band antenna that substantially operates in an operation mode of a single ridge waveguide like that of FIG. 3(*a*).

In this example, a ridge element portion 43 of an antenna element 41 is arranged on the GND 10 without being integrated with a radiation element portion 44. In other words, the ridge element portion 43 corresponds to a ridge portion of a lower wide plane in a single ridge waveguide open cross-section structure. A power supply terminal 100 is connected to a tip end of the ridge element portion 43 in a rectangular parallelepiped shape and a center portion of the radiation element portion 44. FIG. 4B is a graph showing VSWR characteristics of this antenna.

With such a wide band antenna, it is possible to obtain wide-band property at a practical use level, at which the VSWR is around two, but characteristic degradation becomes conspicuous in a band in which a frequency becomes high to some extent.

Figure 5:
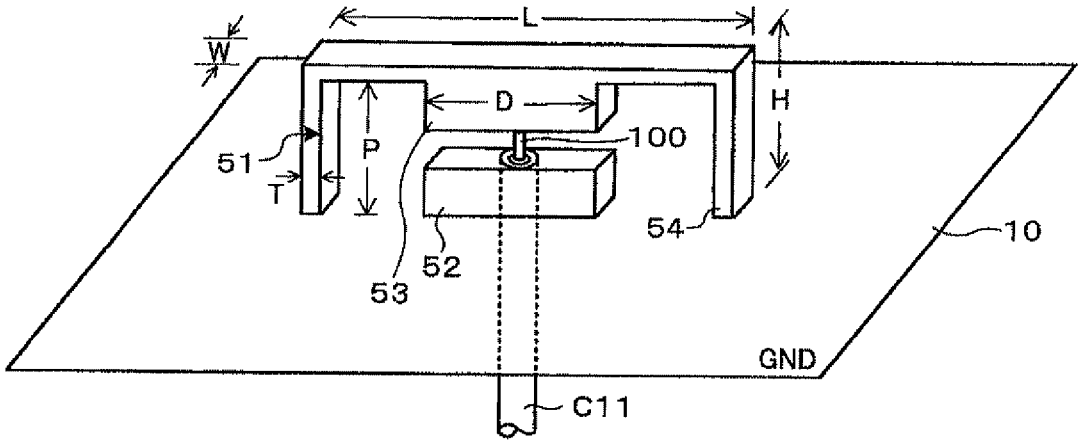
In FIGS. 5, part (*a*) is an external perspective view of an antenna for verification, and part (*b*) is a graph showing VSWR characteristics of the antenna.
Figure 5:
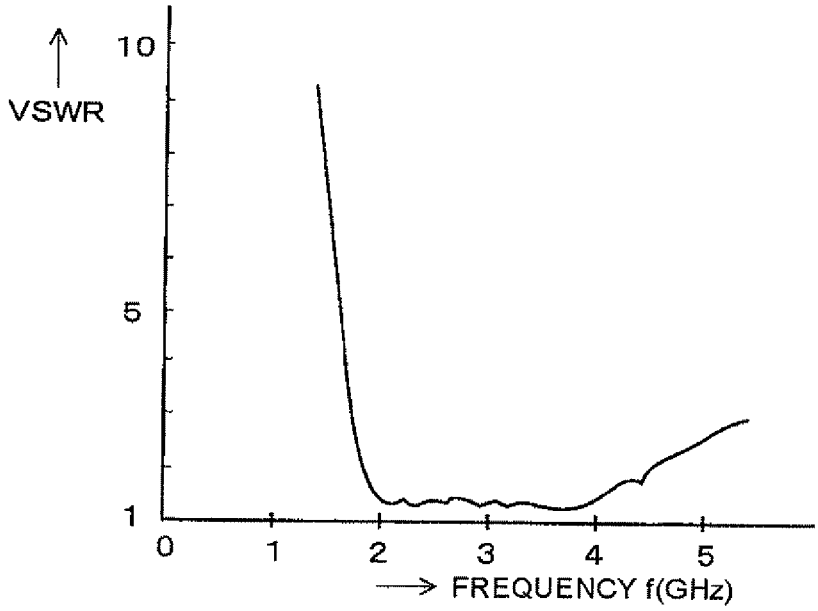

FIG. 5(*a*) is an external perspective view of a wide band antenna configured to realize an operation mode of a known double ridge waveguide. In other words, in this wide band antenna, a ridge element portion 53 of an antenna element 51 is formed in a rectangular shape and an auxiliary element 52 is also formed in a rectangular shape having substantially the same size as the ridge element portion 53. FIG. 5(*b*) is a graph showing VSWR characteristics of such an antenna. It is possible to apply an operation theory of a double ridge waveguide, so wide-band property is improved as compared with the antennas shown in FIGS. 3 and 4.

However, when compared with the VSWR characteristics of FIGS. 1(*b*) and 2(*b*) , an upper limit value of a frequency that is passable at a favorable VSWR is not so high. It can be understood from this fact that it is possible to significantly widen a bandwidth by setting a tip end of a ridge element portion in an approximately arc shape through removal of a corner portion of the tip end.

Third Embodiment

Next, an example of a form in the case where the present invention is carried out as a wide band antenna for UWB used in UWB communication will be described. It is assumed that the UWB communications is performed using the GPS, a wireless LAN, an on-vehicle radar, or the like at a communication frequency of 3.5 [GHz] or higher and a VSWR of 2.0 or less.

Figure 6:
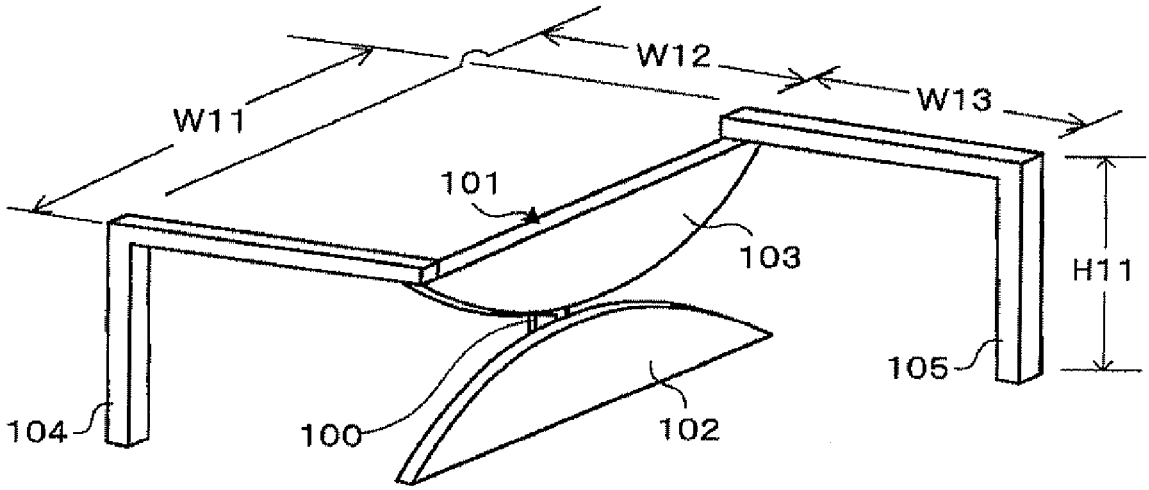
FIG. 6 is an external perspective view of a wide band antenna (antenna for UWB communications) according to a third embodiment of the present invention.

In order to facilitate antenna miniaturization, in this embodiment, a radiation element portion of an antenna element is set to form a predetermined angle with respect to a ridge element portion. For instance, FIG. 6 shows a wide band antenna for UWB communications that includes an antenna element 101 and an auxiliary element 102, with a first radiation element portion 104 and a second radiation element portion 105 of the antenna element 101 respectively extending from both base ends of a ridge element portion 103 vertically with respect to the ridge element portion 103 in mutually opposite directions. A tip end of the ridge element portion 103 is formed in an approximately arc shape. Ends of the first and second radiation element portions 104 and 105 are each placed on the GND 10.

This antenna for UWB communications also utilizes an operation mode of a double ridge waveguide and includes the auxiliary element 102, with a power supply terminal 100 being connected to a tip end of this auxiliary element 102 and a tip end of the ridge portion element 103, in other words, to a site at which an electric field strength becomes the maximum.

The antenna for UWB communications illustrated in FIG. 6 has the following size.

H11=12 [mm], W11=32 [mm], W12=16 [mm], W13=16 [mm]

As to the antenna for UWB communications having such a structure, the result of simulation of VSWR characteristics of an antenna designed on a computer by, for instance, software based on an antenna designing theory and having an error-free ideal shape and actual measurement results of the antenna characteristics of an experimental sample actually produced based on the designing performed by the software are compared with each other.

The sample for experiment is a sample having such fluctuations, accompanying actual production, that the ridge element portion 103 of the antenna element 101 does not have an accurate arc shape, relative angles of the first radiation element 104 and the second radiation element 105 with respect to the ridge element portion 103 do not necessarily become right angles, or a position of the power supply terminal 100 is somewhat displaced from the most tip end of the ridge element portion 103, or a sample in which consideration is given to a sample in which consideration is given to radiation from an end portion of the GND 10.

Figure 7:
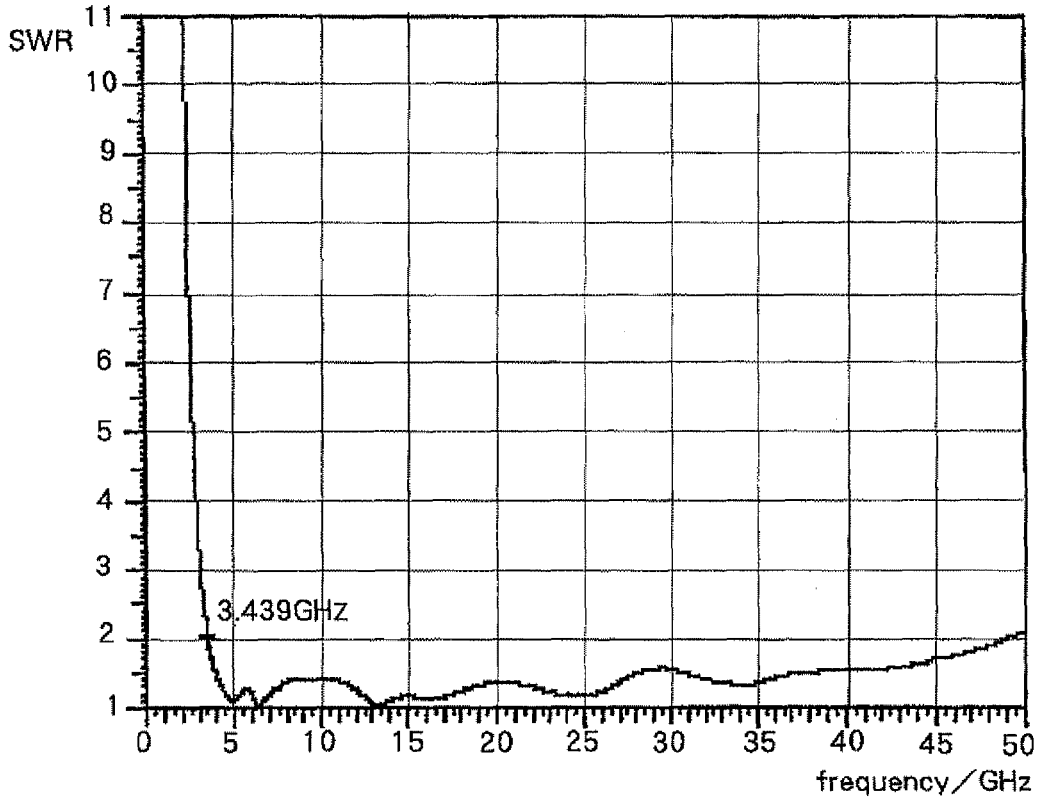
FIG. 7 is a graph showing SWR characteristics according to simulation of the antenna of FIG. 6.
Figure 8:
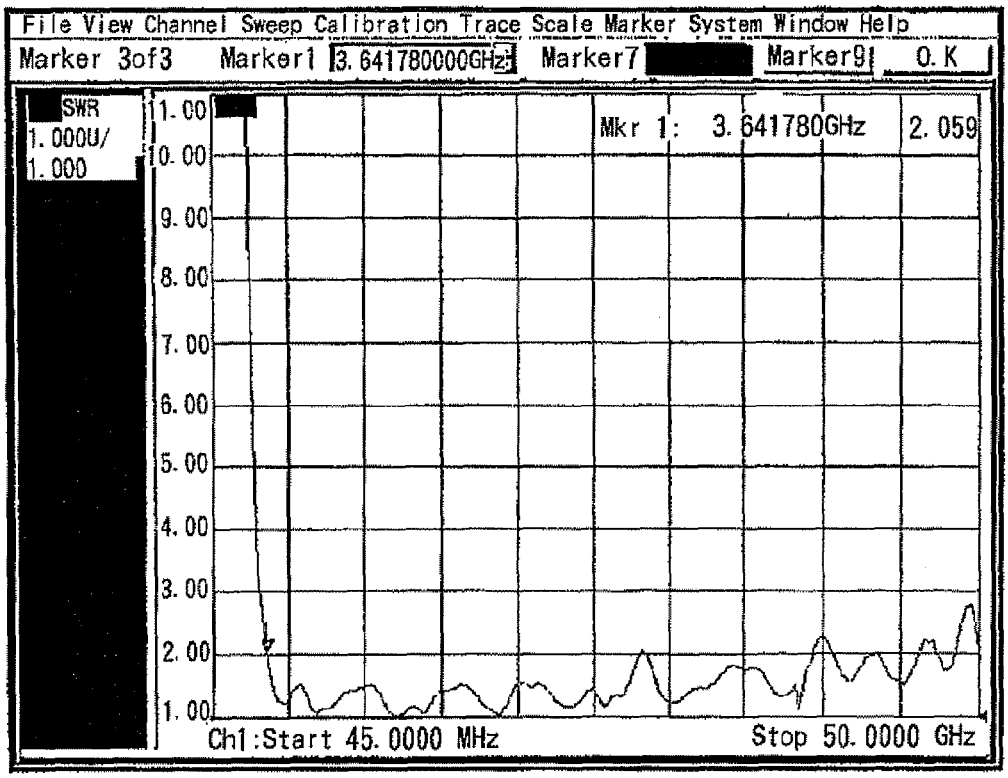
FIG. 8 is a graph showing SWR characteristics according to an experimental sample of the antenna of FIG. 6.
Figure 9:
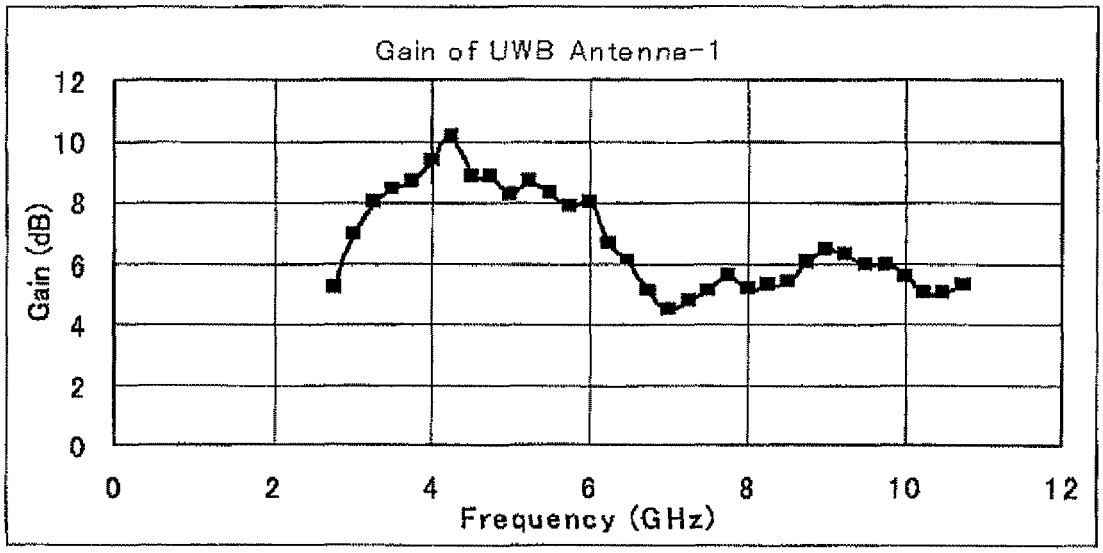
FIG. 9 is a graph showing a gain characteristic by the antenna of FIG. 6 (experimental sample).
Figure 10:
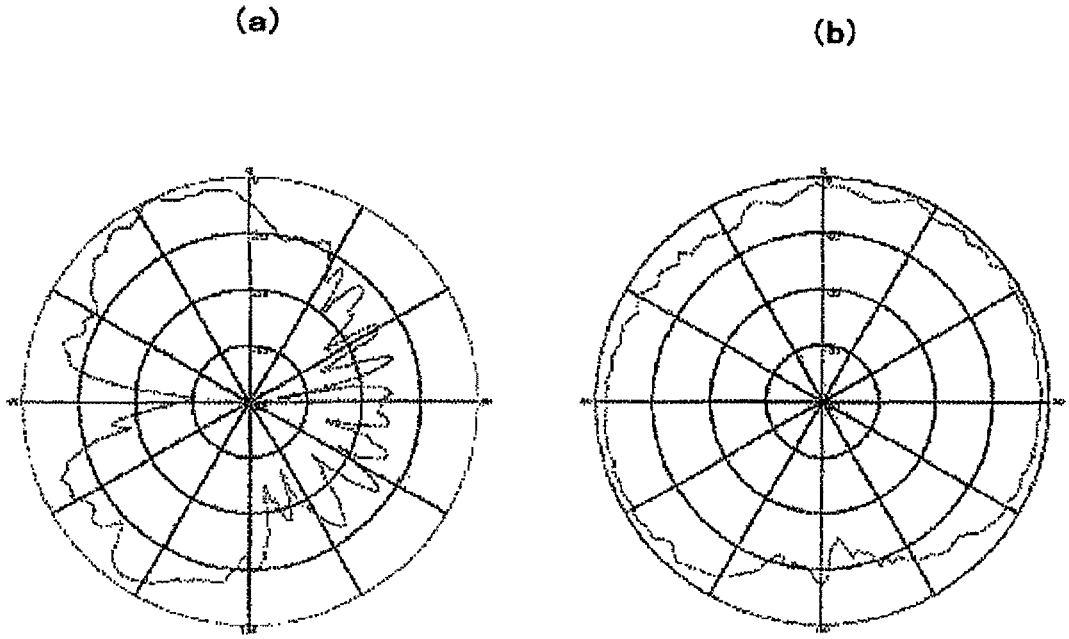
FIGS. 10 are diagrams showing a directional characteristic, in which part A is a diagram showing a directional characteristic in a vertical direction of the antenna of FIG. 6 (experimental sample), and part B is a diagram showing a directional characteristic in a horizontal direction.

FIG. 7 is a graph showing SWR characteristics of the simulation result and FIG. 8 is a graph showing SWR characteristics of the actual measurement result. Also, as shown in FIG. 9, a gain characteristic of the experimental sample having the size described above exceeds four to five (dB: input-output ratio) in a frequency band that is in demand at this point in time, which proves that the gain characteristic is in a practicable range. A radiation characteristic obtained for a vertical plane is shown in FIG. 10 (*a*) and the radiation characteristic obtained for a horizontal plane is shown in FIG. 10(*b*). Approximately non-directivity is exhibited in a horizontal direction.

As can be understood from these actual measurement results, when the antenna structure shown in FIG. 6 is adopted, SWR characteristics in the case of the simulation and that in the case of the experimental sample differ from each other to some extent in a higher frequency band but a value of the SWR (VSWR in the case of a voltage ratio) is stabilized at a certain frequency or higher and a frequency, at which the value becomes two or less, extends close to 50 [GHz].

This means that there exists a large allowable range at the time of antenna designing/production, so an antenna structure suited for mass production is obtained. At the time of actual production of a wide band antenna, there occurs fluctuations due to a process error, mismatching between a coaxial connector for power supply and a cable (which particularly tends to occur in the case of a millimeter wave), an attachment error of the power supply terminal 100, a loss caused by an antenna material (such as a loss caused by a jointing material) , a measurement error, or the like. However, with the structure of the antenna for UWB communications in this embodiment, even when there is some designing/production fluctuations, the characteristic that is approximately the same as the result of the simulation is obtained. In other words, the integral part that an antenna that is compact and high gain and has an ultrawide-band property is realized is maintained.

It is considered that one factor of the fact described above is that the antenna element 101 forms a shape of a ridge waveguide open cross-section structure together with the GND 10 when it is spread and a tip end of the ridge element portion 103 and a tip end of the auxiliary element 102 are both in an approximately arc shape.

In the case of the wide band antenna shown in FIG. 6, a practical lowest communicable frequency at the size described above is 3.4396 [GHz] and it is possible to use any frequency so long as it is equal to or higher than the practical lowest communicable frequency. Accordingly, when designing/production is performed in a size suited for the lowest usable frequency, it becomes possible to use one antenna as multiple antennas for communication.

It can be said that such a property is a property that is considerably suited for UWB communication, whose application is expected to dramatically widen in the future, in particular, an antenna for multiple on-vehicle communication devices. When this antenna for UWB is attached to an automobile or the like, it is possible to set a body of the automobile or the like as the GND plane, which is extremely convenient.

Fourth Embodiment

Figure 11:
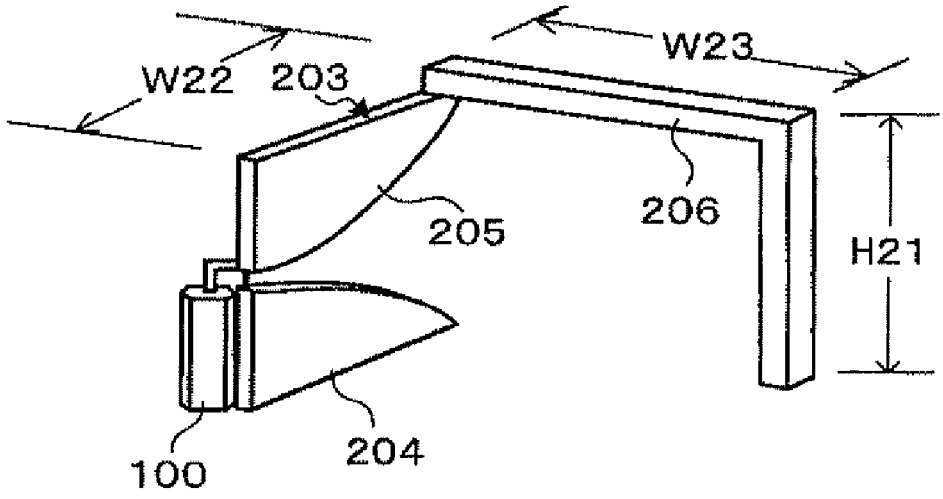
FIG. 11 is an external perspective view of a wide band antenna (antenna for UWB communications) according to a fourth embodiment of the present invention.

The antenna for UWB communications may be an antenna having a structure shown in FIG. 11. The antenna shown in FIG. 11 corresponds to an antenna obtained by cutting the antenna for UWB of FIG. 6 into two parts while setting portions with the maximum heights of the antenna element 101 and the auxiliary element 102 as a center.

In other words, a ridge element portion 205 of an antenna element 203 and an auxiliary element 204 opposing this ridge element portion 205 are each formed in a half arc shape. A power supply terminal 100 is connected to each of a tip end of the ridge element portion 205 of the antenna element 203 and a tip end of the auxiliary element 204. An antenna size is set as follows.

H21=12 [mm], W22=16 [mm], W23=16 [mm]

In the case of the antenna for UWB having the structure of FIG. 11, a gain is lowered to some extent as compared with that of the antenna shown in FIG. 6 but a VSWR characteristic pattern and the radiation characteristic becomes approximately the same as those of the antenna shown in FIG. 6. In a use in which importance is placed on antenna miniaturization, the antenna for UWB shown in FIG. 11 is suited.

Fifth Embodiment

Figure 12:
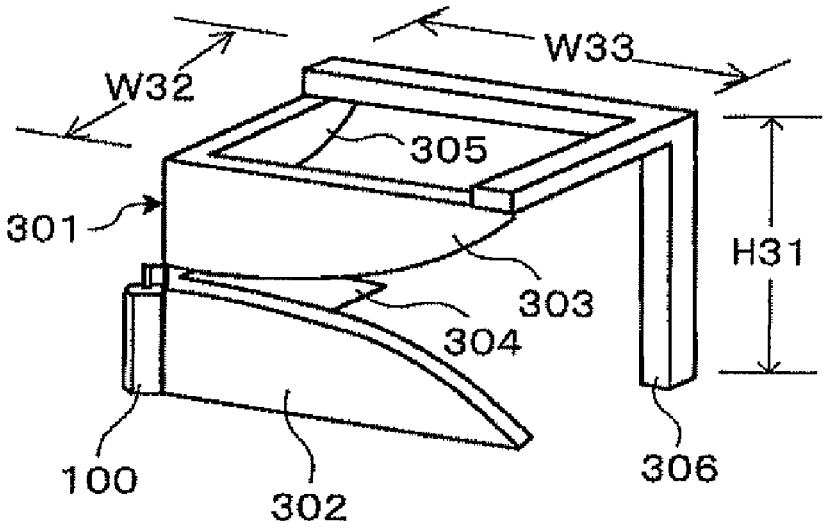
FIG. 12 is an external perspective view of a wide band antenna (antenna for UWB communications) according to a fifth embodiment of the present invention.

FIG. 12 shows a modification of the antenna for UWB communications. It is possible to say that this antenna is an antenna in which two antennas for UWB communication shown in FIG. 11 are combined with each other.

In other words, ridge element portions 303 and 305 of an antenna element 301 have a both base end structure that is symmetric with a site, at which a height of a ridge portion of a double ridge waveguide in a double ridge waveguide open cross-section structure becomes the maximum, as a center line and a radiation element portion 306 includes first elements respectively corresponding to wide walls of the double ridge waveguide and extending from both base ends of the ridge element portions and a second element corresponding to a side wall of the double ridge waveguide and shared as an element extending from the two first elements, with an end portion of the second element extending onto the GND. Auxiliary elements 302 and 304 are the same size as the ridge element portions 303 and 305 and oppose those ridge element portions, and a power supply terminal 100 is connected to each tip end.

Lengths W32 and W33 of the paired first elements are each 16 [mm] and a length (antenna height) H31 of the second element is 12 [mm].

With the antenna for UWB communications having such a structure and size, it becomes possible to significantly improve a gain characteristic even with a size that is approximately the same as that of the antenna shown in FIG. 11 from the viewpoint of implementation. As a result, it becomes possible to realize a superior antenna for UWE communications that has all of a small size, wide-band property, and the gain characteristic.

Sixth Embodiment

Figure 13:
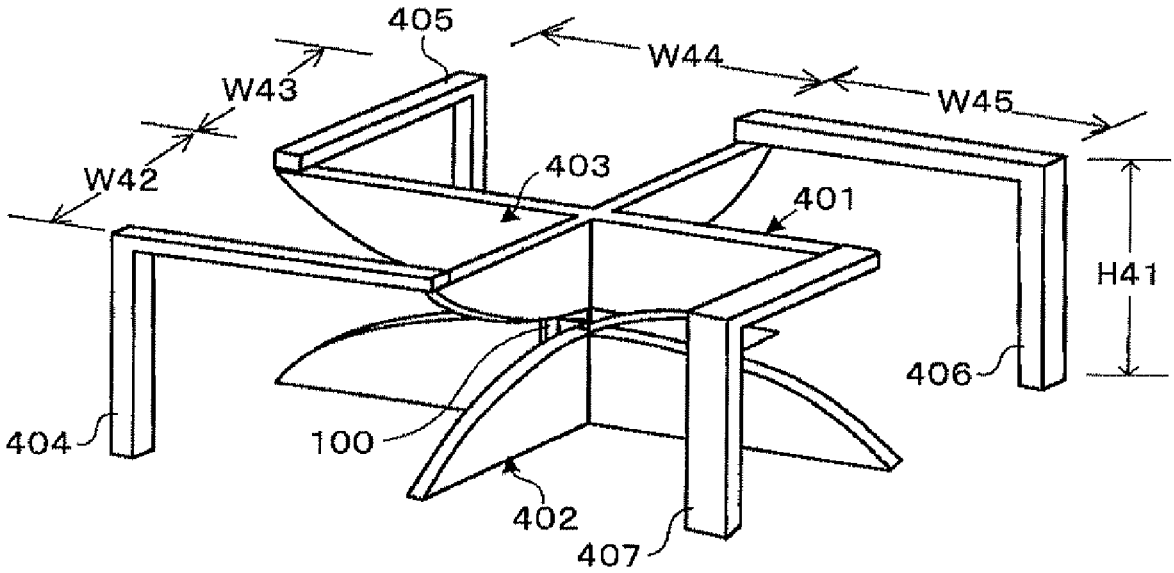
FIG. 13 is an external perspective view of a wide band antenna (antenna for UWB communications) according to a sixth embodiment of the present invention.

FIG. 13 shows another modification of the antenna for UWS communications. It is possible to say that this antenna is an antenna in which two antennas for UWB communication shown in FIG. 6 or four antennas for UWE communication shown in FIG. 11 are combined with each other.

When compared with the antenna for UWB communications of FIG. 6, the antenna in this modification corresponds to an antenna in which two antenna elements 101 are set to intersect at right angles with a center symmetric line of each ridge element portion 103 as a base point. In other words, the antenna for UWB communications in this modification includes an antenna element 401 including two ridge element portions 403, which each have both base ends, and four radiation element portions 404, 405, 406, and 407 extending from respective base ends and an opposing auxiliary element 402 having the same shape and size as the ridge element portions 403 of this antenna element 401. A power supply terminal 100 is connected to each of tip ends of the ridge element portions 403 and a tip end of the auxiliary element 402. The paired radiation element portions 404 and 406 extend vertically to the ridge element portion 403 in mutually opposite directions and the paired radiation element portions 405 and 407 also extend vertically with respect to the ridge element portion 403 in mutually opposite directions, with their end portions being placed on the GND.

An antenna size is set as follows.

H41=12 [mm], W42=W43=W44=W45=16 [mm]

The antenna for UWB communications having such a structure and size has more non-directivity than the antenna for UWB communications shown in FIG. 6 even with a size that is approximately the same as that of the antenna shown in FIG. 6 from the viewpoint of implementation. As a result, it becomes possible to realize a superior antenna for UWB communications that has all of a small size, wide-band property, high gain characteristic, and non-directivity.

Advantage of Wide Band Antenna in Embodiments

The wide band antenna according to the present invention has been described above based on multiple embodiments, and a feature common to each embodiment is that the wide band antenna according to the present invention is an ultra-wide band antenna that, based on a waveguide mode, has only the lowest usable frequency and achieves non-directivity on a certain plane. Such characteristics are extremely important for a general-purpose antenna for UWB communications whose application is expected to dramatically widen in the future.

With the antenna having the structure of FIG. 11, it becomes possible to further facilitate miniaturization and in the examples shown in FIGS. 12 and 13 in which multiple antennas are combined with each other, it becomes possible to obtain a high gain at the time of UWB communication even with a small size.

It should be noted here that the structures, sizes, materials, and the like of the wide band antennas (antennas for UWB communication) described in this specification are merely examples and other implementation within a range of the feature of the present invention is included in a range of the present invention.

INDUSTRIAL APPLICABILITY

It is possible to use the wide band antenna according to the present invention as an antenna for UWB communications as well as an antenna for a mobile terminal, such as a portable telephone or a PDA, which is expected to use multiple frequencies but whose antenna attachment position is limited, a GPS antenna, a reception antenna for a terrestrial digital broadcasting system, a transmission/reception antenna for a wireless LAN, a reception antenna for satellite digital broadcasting, an antenna for a cellular phone, an antenna for ETC transmission/reception, a radio wave sensor, an antenna for a radio broadcasting receiver, and many other antennas. The maximum advantage of the wide band antenna according to the present invention resides in that it becomes possible to cope with these many applications using one antenna.

The invention claimed is:

1. A wide band antenna comprising:

an antenna element forming, together with a ground plane, a shape of a part or all of a planar cross-section structure of a ridge waveguide, wherein the antenna element includes a ridge element portion for antenna characteristic adjustment corresponding to a ridge portion of the ridge waveguide and a radiation element portion for electromagnetic wave radiation corresponding to a wall of the ridge waveguide, said radiation element portion extending from the ridge element portion and having an end portion extending toward and onto the ground plane, with a power supply terminal being connected to a tip end of the ridge element portion.

2. A wide band antenna according to claim 1, wherein the ridge element portion is formed in an approximately arc shape.

3. A wide band antenna according to claim 2, wherein the ridge element portion has a one base end structure obtained by cutting the ridge portion of the ridge waveguide in the open cross-section structure in a height direction, and the radiation element portion extends from a base end of the ridge element portion.

4. A wide band antenna according to claim 2, wherein the ridge element portion has a two-end structure that is symmetric across a center plane, said center plane at a location where a height of the ridge portion of the ridge waveguide is a maximum, and the radiation element portion extends from each of the ends of the ridge element portion.

5. A wide band antenna according to claim 4, wherein the radiation element portion extends from each of the ends of the ridge element portion in a predetermined angle direction with respect to the ridge element portion.

6. A wide band antenna according to claim 5, wherein the radiation element portion extends from each of the ends of the ridge element portion vertically to the ridge element portion in mutually opposite directions.

7. A wide band antenna according to claim 6, wherein two of the antenna elements are set so as to intersect at right angles with a center symmetric line of each ridge element portion as a base point.

8. A wide band antenna according to claim 2, wherein the ridge element portion has a two-end structure that is symmetric across a center plane, at a location where a height of the ridge portion of the ridge waveguide is the maximum, and is angled in a lateral plane of the ridge waveguide at a predeterminded angle, and in the radiation element portion, first elements each correspond to a wide wall of the ridge waveguide extend from both ends of the ridge element portion and share a second element corresponding to a side wall of the ridge waveguide.

9. A wide band antenna according to claim 1, further comprising:

an auxiliary element having the same shape and structure as the ridge element portion of the antenna element, wherein a base end of the auxiliary element is arranged on a ground plane, the auxiliary element and the ridge element portion oppose each other on the same plane, an end of the radiation element portion of the antenna element is arranged on the ground plane, and the power supply terminal is connected to a site at which a tip end of the auxiliary element and a tip end of the ridge element portion of the antenna element come closest to each other.

10. A wide band antenna according to claim 1, wherein the radiation element has:

a first portion extending from an end of the ridge element portion off-parallel to the ridge element portion; and an end portion extending from the first portion to the ground plane.

11. A wide band antenna cooperating with a ground plane to form part or all of a cross-sectional structure of a ridge waveguide, the antenna comprising:

a ridge element; and a radiation element comprising:

a first portion extending from an end of the ridge element parallel to the ground plane; and an end portion extending from the portion to the ground plane, wherein:

the ridge element is a double-end element having:

a ridge element first portion extending to a first end of the double-end element; and a ridge element second portion extending to a second end of the double-end element, which is non-parallel to the ridge element first portion; and there are a pair of said radiation elements being a first radiation element and a second radiation element;

the first portions of the first radiation element and the second radiation element respectively extend from the first end and the second end of the ridge element to a single said radiation element end portion.

12. The antenna of claim 11 in combination with a power supply terminal and wherein the power supply terminal is connected to a tip end of the ridge element.

13. The antenna of claim 11 wherein:

the ridge element is a planar double-ended ridge element.

14. The antenna of claim 11 further comprising:

an auxiliary element having the same shape as the ridge element and having a base on the ground plane and opposing the ridge element in a coplanar position.

15. The antenna of claim 11 wherein:

the first portion of the first radiation element and the first portion of the second radiation element extend off-parallel to the ridge element.

* * * * *